US008915258B1

(12) United States Patent
Beam et al.

(10) Patent No.: US 8,915,258 B1
(45) Date of Patent: Dec. 23, 2014

(54) GROUND BLIND WITH IMPROVED ACCESS OPENING

(75) Inventors: Keith Beam, New Glarus, WI (US); Scott D. Lee, Madison, MS (US)

(73) Assignee: Primos, Inc., Flora, MS (US)

( * ) Notice: Subject to any disclaimer, the term of this patent is extended or adjusted under 35 U.S.C. 154(b) by 21 days.

(21) Appl. No.: 13/350,617

(22) Filed: Jan. 13, 2012

(51) Int. Cl.
*E04H 15/58* (2006.01)

(52) U.S. Cl.
USPC ..... 135/117

(58) Field of Classification Search
USPC ..... 135/117, 119, 143, 147
See application file for complete search history.

(56) References Cited

U.S. PATENT DOCUMENTS 3,782,399 A * 1/1974 Milner ..... 135/117
4,437,505 A * 3/1984 Rodgers ..... 160/126
4,962,782 A * 10/1990 Landrum ..... 135/119
5,069,572 A * 12/1991 Niksic ..... 403/170
5,193,602 A * 3/1993 Morales ..... 160/89
5,628,338 A * 5/1997 Stumbo ..... 135/147
7,320,332 B2 * 1/2008 Reis ..... 135/115
7,475,699 B2 * 1/2009 Johnson et al. ..... 135/117
7,665,478 B2 * 2/2010 Wehner ..... 135/126
7,789,098 B2 * 9/2010 Livacich et al. ..... 135/115
7,984,725 B1 * 7/2011 Johnson et al. ..... 135/115
2011/0168221 A1 * 7/2011 Schlipf ..... 135/143

* cited by examiner

*Primary Examiner* — Noah Chandler Hawk
(74) *Attorney, Agent, or Firm* — Holland & Hart

(57) ABSTRACT

A ground blind includes a collapsible support structure and a flexible cover mounted to the collapsible support structure. The flexible cover includes a top, at least one sidewall, at least one opening, at least one elastic member, and at least one fastener. The elastic member is configured to bias the opening into an open position. The fastener is configured to releasably hold the opening in a closed position.

33 Claims, 8 Drawing Sheets

GROUND BLIND WITH IMPROVED ACCESS OPENING

TECHNICAL FIELD

The present application is directed to portable and collapsible blinds for use by sportsmen, and more particularly relates to access openings into portable and collapsible blinds and related methods.

BACKGROUND

Hunters, photographers, bird watchers, etc. (referred to hereinafter individually as a "sportsman" for convenience) often desire or have a need to remain hidden from view of wildlife they are observing or pursuing. Portable and collapsible shelters or blinds ("blind") are often used to hide the sportsman from view. Blinds typically include a collapsible support structure and a camouflage fabric cover secured to the support structure. The blind is typically set up for use by expanding the collapsible support structure to create an internal spaced within which the sportsman may enter through a door or opening defined in the cover.

Doors or openings in blinds are usually opened and closed using a zipper. The zipper may be arranged to close an open in a vertical direction. Typically, the cover extends continuously around a periphery of the blind to maintain the blind in an assembled condition. The door may be provided in a sidewall or at a corner of the blind, with a bottom end and top end of the door extending from a bottom portion of the blind to a top portion of the blind. In some blinds, unzipping the door creates a narrow vertical opening in the sidewall of the cover, which requires the sportsman to pull down on the blind to enlarge the opening to enable access. If the opening is extended in the vertical direction, more material will be available along the length of the door or opening to make it easier for the user to pull down vertically on the side edges of the opening to create an enlarged opening for access into the blind. Forcing the sides down to widen the access opening in the blind after unzipping the blind is awkward and cumbersome. It becomes especially difficult when the sportsman needs to insert not only his or he body through the opening but gear also.

Traditional blind access openings that utilize zippers are also noisy. Minimizing noise is always an object of sportsmen, especially bowhunters and others who need to get close to game animals. The mechanical sound of a zipper or other mechanical fasteners, such as certain types of plastic buckles and clips, may be heard at significant distances by game animals.

Opportunities exist for improvements in access openings for blinds.

SUMMARY

One aspect of the present disclosure relates to a ground blind that includes a collapsible support structure, a flexible cover, and a door arrangement. The flexible cover is mounted to the collapsible support structure and includes a top and a continuous sidewall. The sidewall defines a plurality of side panels. The door arrangement include a door opening spanning a corner defined by an intersection of a pair of adjacent side panels, and at least one door panel member configured to cover the door opening when the at least one door panel member is in a closed position. The at least one door panel member is movable into an open position to expose a portion of the door opening and provide unencumbered access into the ground blind.

The ground blind may also include at least one elastic member configured to bias the at least one door panel member into the open position. The at least one door panel member may include first and second door panel members that define first and second opening edges, respectively. The at least one elastic member may be configured to move at least one of the first and second opening edges away from the other of the first and second opening edges upon release of the at least one fastener. The at least one elastic member may include a first elastic member associated with the first opening edge and a second elastic member associated with the second opening edge, wherein the first and second elastic members operate to move the first and second opening edges away from each other upon release of the at least one fastener.

The ground blind may also include at least one fastener configured to releasably hold the at least one door panel member in the closed position. The collapsible support structure may include a separate frame subassembly supporting each of the side panels and top of the flexible cover. Each frame subassembly may include a plurality of frame legs. The frame subassemblies supporting the side panel that the door opening spans may each include at least one tension member that expends between adjacent frame legs to maintain tension in the frame subassembly.

The at least one door panel member may define at least one opening edge arranged horizontally, and the at least one door panel member may be gatherable to vertically move the at least one opening edge. The at least one elastic member may operate to automatically adjust the at least one door panel member from the closed position to the open position. The collapsible support structure may include a separate frame subassembly supporting each of the side panels and top of the flexible cover, wherein each frame subassembly includes a plurality of frame legs, and the at least one door panel member is connected to the frame legs. The at least one door panel member is slideable along the frame legs to move from the closed position to the open position.

Another aspect of the present disclosure relates to a ground blind that includes a collapsible support structure, a cover, and a door assembly. The collapsible support structure includes a plurality of frame members. The cover is connected to the collapsible support structure. The cover includes at least two side panels that intersect at a corner and a door opening defined in the corner and extending onto the two side panels. The door assembly includes first and second door panels that are vertically movable between a closed position covering the door opening and an open position wherein portions of the door opening are exposed to provide unobstructed access into the ground blind at the corner.

The first door panel may define a first horizontally oriented edge, and the second door panel may define a second horizontally oriented edge. The first and second door panels may be vertically movable to separate the first and second horizontally oriented edges away from each other. The door assembly may include at least one fastener configured to hold the first and second door panels in the closed position. The ground blind may further include a biasing member operable to automatically move the first and second door panels away from each other into the open position. The collapsible support structure may include at least one tension member extending between pairs of the frame members at a location adjacent to the door opening to maintain tension in the cover.

Another aspect of the present disclosure relates to a method of controlling access into a ground blind. The method includes providing a ground blind having a collapsible support structure, a flexible cover, and a door arrangement. The flexible cover includes a pair of side panels that intersect at a corner. The door arrangement includes a door opening at the corner that extends onto the pair of side panels, and at least one door panel member sized to cover the door opening in a closed position and expose at least a portion of the door opening in an open position. The method also includes maintaining tension in the collapsible support structure when the at least one door panel member is in the closed and open positions, and operating the door arrangement to provide unencumbered access into the ground blind through the door opening at the corner.

The door arrangement may include at least one fastener assembly, and the method further includes operating the at least one fastener assembly to hold the at least one door panel member in a closed position. The door arrangement may include a biasing member coupled to the at least one door panel member, and the method further includes applying a biasing force to the at least one door panel member with the at least one biasing member to automatically move the at least one door panel member into the open position upon release of the at least one fastener assembly. The at least one door panel member may include first and second door panel members, and the method includes moving the first and second door panel members vertically away from each other to expose a portion of the door opening.

The at least one door panel member may include first and second door panel members, and the at least one fastener assembly may include a first portion mounted to the first door panel member and a second portion mounted to the second door panel member, and releasing the at least one fastener assembly includes disconnecting the first and second portions. The at least one door panel member may be connected directly to the collapsible support structure. The ground blind may include a door retention member having a first end connected to the at least one door panel member and a second end accessible through the flexible cover, wherein applying tension at the second end moves the at least one door panel member relative to the door opening.

Another aspect of the present disclosure relates to a method of operating an opening into a ground blind. The method includes providing a collapsible ground blind having a cover and a door assembly, wherein the cover includes at least two side panels that intersect at a corner, the door assembly includes a door opening defined at the corner and extending onto the two side panels, and at least one door panel. The method also includes holding the door panel in a closed position covering the door opening, releasing the door panel to an open position to expose a portion of the door opening at the corner to provide unobstructed access into the ground blind at the corner, and maintaining tension in the cover when the door panel is in the closed position and the open position.

The method may include automatically moving the at least one door panel into the open position upon releasing the door panel. Automatically moving the at least one door panel may include moving the at least one door panel vertically. The method may include gathering the at least one door panel after releasing the door panel. The door assembly may comprises a biasing member connected to the at least one cover member, and automatically moving the at least one door panel may include applying a biasing force from the biasing member on the at least one door panel.

The door assembly may include at least one fastener configured to hold the at least one door panel in the closed position, and releasing the at least one door panel into the open position includes releasing the at least one fastener. The method may include applying tension in the cover with at least one tension member that is operable independent of the door assembly.

BRIEF DESCRIPTION OF THE DRAWINGS

The accompanying drawings illustrate a number of embodiments of the instant disclosure and are part of the specification. Together with the following description, the drawings demonstrate and explain principles of the instant disclosure.

Figure 1:
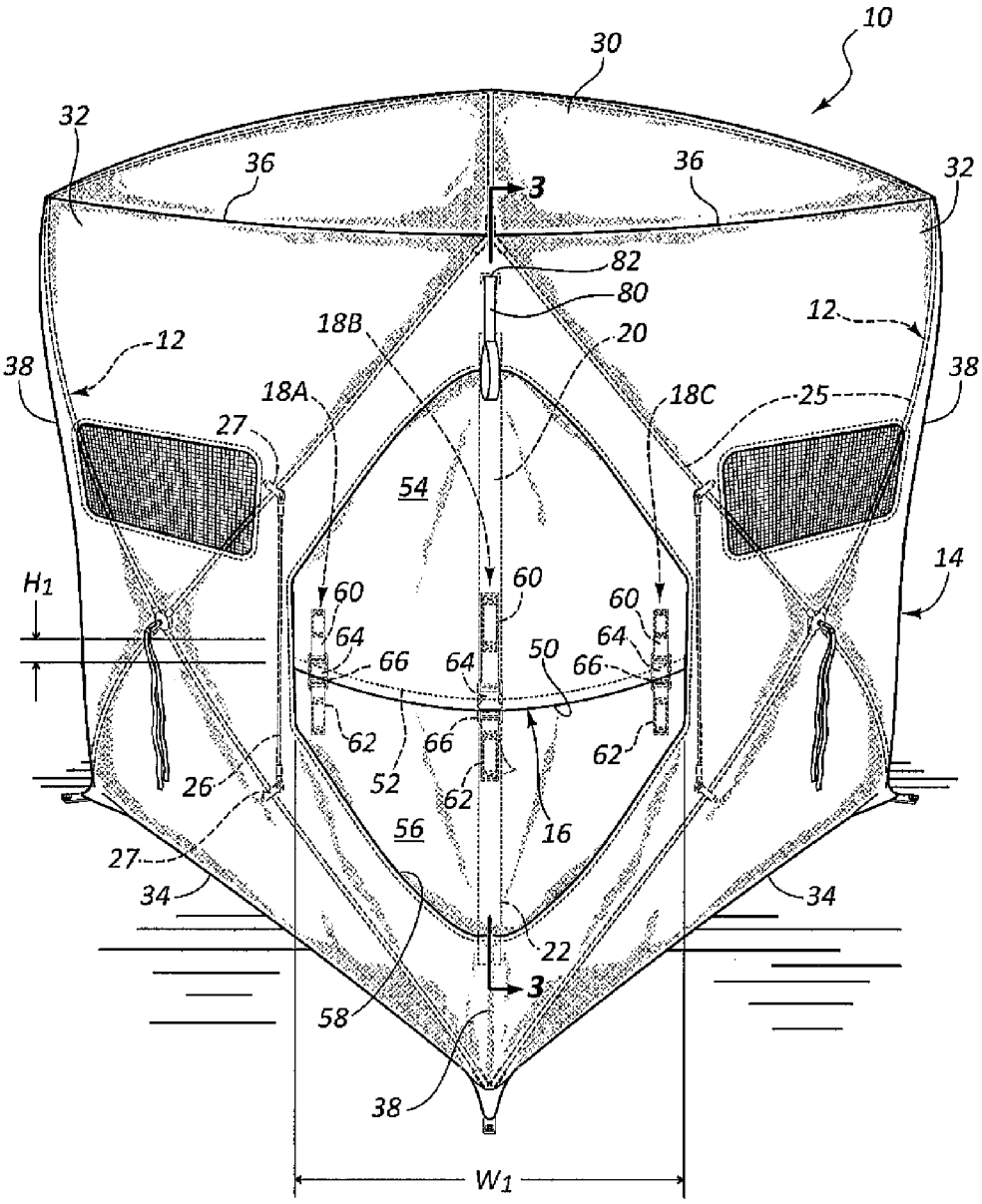
FIG. 1 is a perspective view of an example ground blind having an access opening in a closed position according to the present disclosure.

Throughout the drawings identical reference characters and descriptions indicate similar, but not necessarily identical, elements. While embodiments of the instant disclosure are susceptible to various modifications and alternative forms, specific embodiments have been shown by way of example in the drawings and will be described in detail herein. However, one of skill in the art will understand that embodiments of the instant disclosure are not intended to be limited to the particular forms disclosed herein. Rather, the instant disclosure covers all modifications, equivalents, and alternatives falling within the scope of embodiments defined by the appended claims.

DETAILED DESCRIPTION

The present disclosure is directed to ground blind assemblies, access openings into ground blind assemblies, and related methods of opening and closing access openings into ground blinds. One aspect of the present disclosure is directed to a collapsible ground blind assembly having an access opening constructed as a door opening. The access opening is defined by opposing upper and lower opening edge portions arranged generally horizontally when the access opening is in a closed position. The access opening is held in a closed position with at least one fastener such as a buckle that spans across the access opening. Release of the fastener permits the access opening to move into an open position having a sufficient height and width for a user or gear to enter into the ground blind. The access opening may automatically move into an open position using a biasing force applied by at least one elastic member associated with at least one of the upper and lower opening edge portions. The access opening may be held in an open position or increased in size using a retention member associated with at least on of the upper and lower opening edge portions. The construction of the access opening permits opening and closing of the door without use of zippers.

Other constructions are possible for access openings according to the present disclosure. For example, the access opening may be arranged vertically rather than horizontally so that release of the fastener provides automatic opening of the access opening in a horizontal direction rather than a vertical direction. The access opening may be defined in a single sidewall panel of the ground blind, or in other arrangements span adjacent sidewall panels of the ground blind. The access opening may be constructed as a door, as described in the above example, or may be constructed as a different type of access opening such as, for example, a window or air vent in a sidewall or top of the ground blind.

One advantage of the example access openings disclosed herein relates to the size of the opening when in the open position. Access openings that use a zipper are sometimes difficult to widen sufficiently to create an opening large enough for a particular type of access (e.g., access as a door through which the user and/or the user's gear may pass), and usually create an undesirable sound when opening and closing the zipper. The access openings of the present disclosure provide both width and height of the access opening in an open position without the user exerting forces on the opening edge portions. The access opening may move between closed and open positions automatically upon release of the fastener holding the access opening in the closed position. The access opening may also operate without the use of a zipper.

Figure 2:
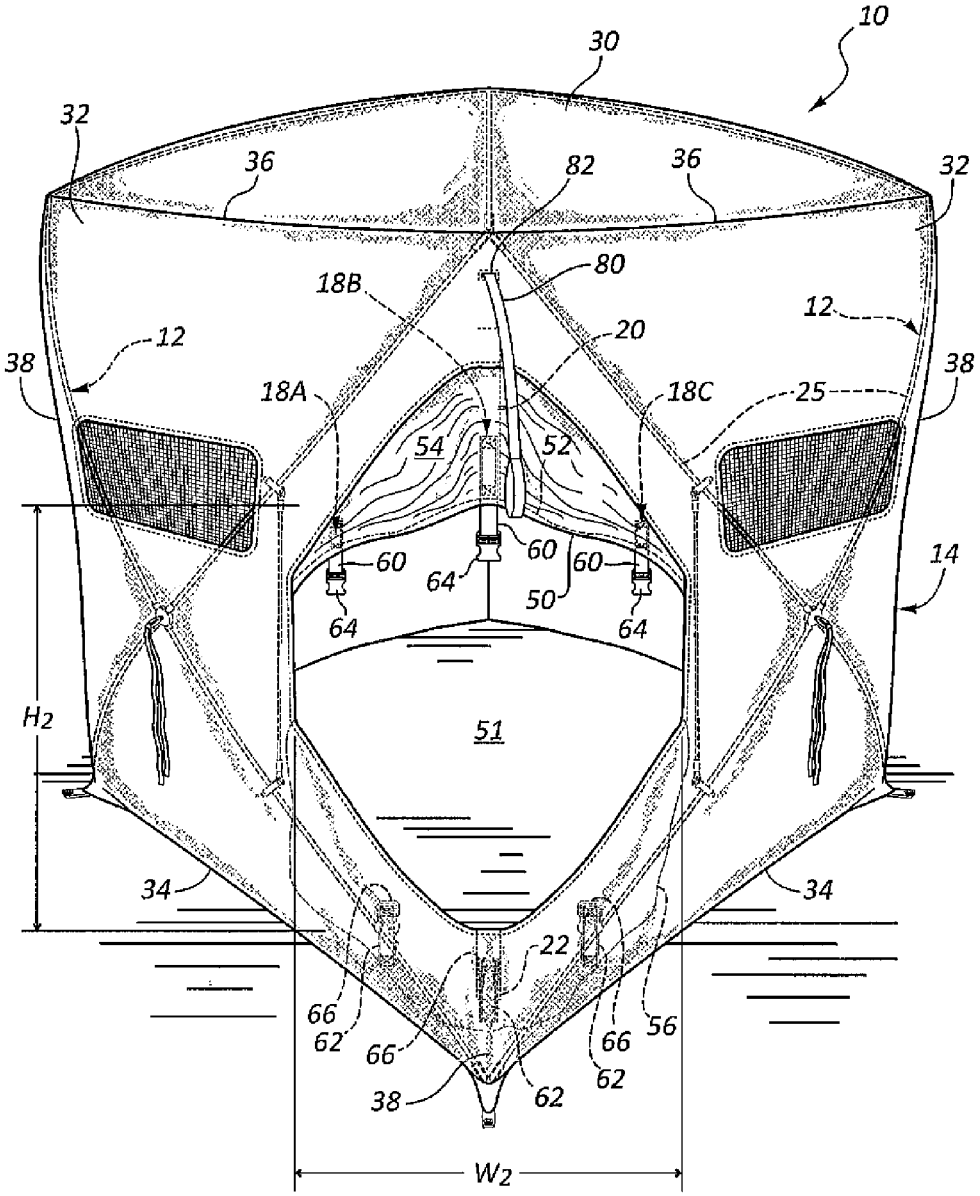
FIG. 2 is a perspective view of the ground blind of FIG. 1 with the access opening in an open position.

Referring now to FIGS. 1-5, an example ground blind 10 is shown including a collapsible support structure 12, a cover 14, and a door assembly 16. FIG. 1 illustrates the door assembly 16 in a closed position in a generally horizontal orientation. The door assembly 16 is held closed with a plurality of fasteners 18A-C. Releasing the fasteners 18A-C permits movement of the door assembly 16 into an open position as shown in FIG. 2. The open position shown in FIG. 2 may occur automatically using biasing forces applied by first and second elastic members 20, 22 associated with opposing side portions or panels of the door assembly 16. In some arrangements, an elastic member may operate to pull the top portion of the door assembly 16 upward while gravity acts on the lower portion of the door opening to pull the lower portion downward.

The collapsible support structure 12 may include a plurality of crossing support members 25 when in an expanded position shown in FIGS. 1 and 2. The support members 25 cross each other centrally on each side panel and across the top or roof of the ground blind 10. The collapsible support structure 12 may retract or collapse into a retracted position for easier transport and stowage of the ground blind 10. When the collapsible support structure 12 is in the expanded position shown in FIGS. 1 and 2, an interior space is defined within the ground blind 10.

Figure 4:
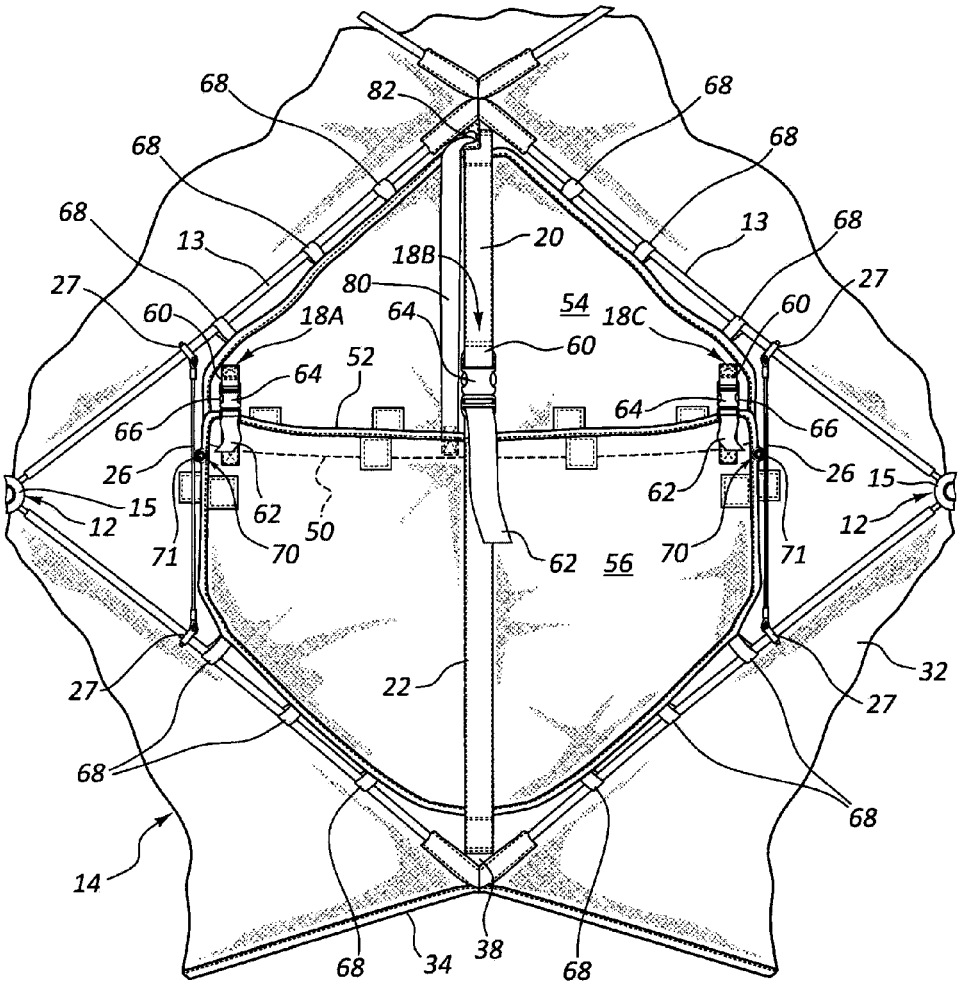
FIG. 4 shows the access opening of FIG. 1 from within the ground blind with the access opening in a closed position.
Figure 5:
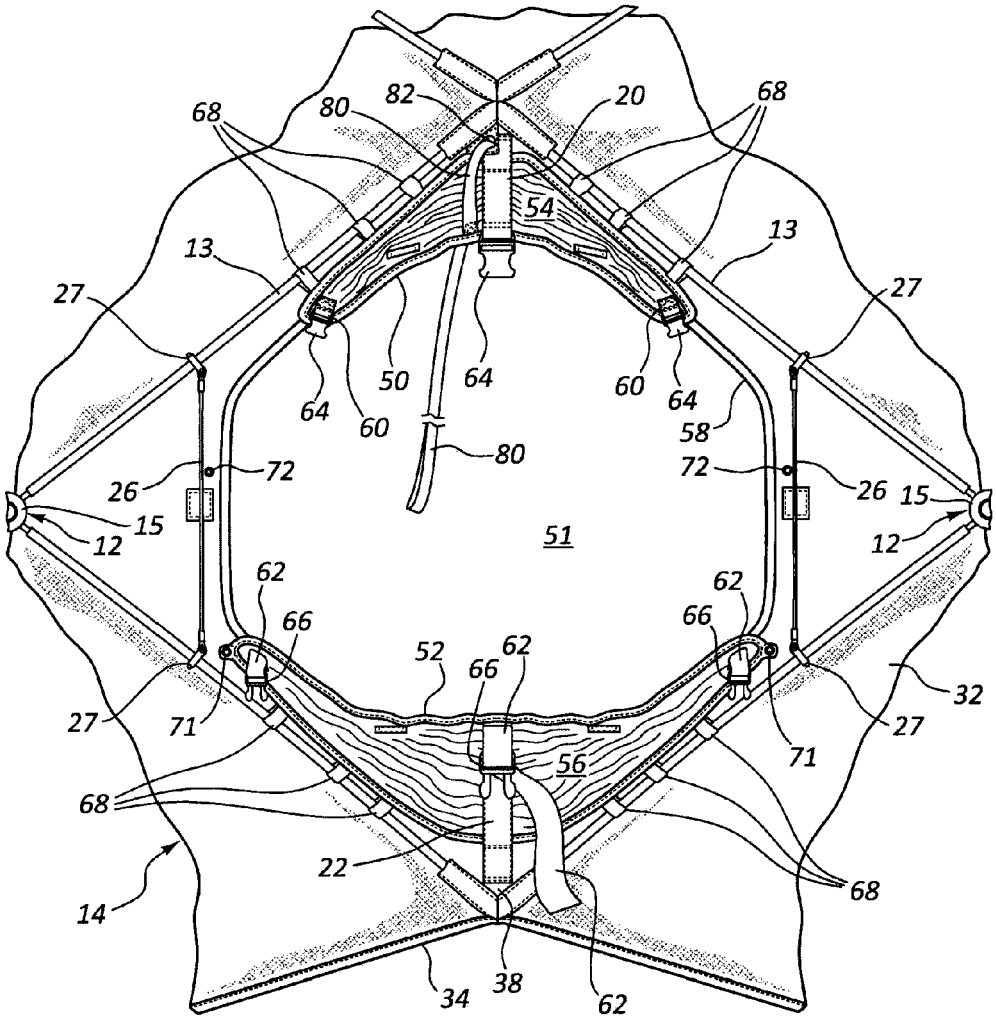
FIG. 5 shows the access opening of FIG. 4 in an open position.

The collapsible support structure 12 may also include a pair of tensioning members 26 that extend between support members 25 on opposite sides of the door assembly 16 (see FIGS. 4-5). The tensioning members 26 may be connected to the support members 25 with connectors 27 mounted on each of the support members 25. The connectors 27 may be adjustable to different positions along a length of the support members 25. The tensioning members 26 may apply tension in the collapsible support structure 12 that helps maintain the ground blind 10 in an open or expanded position. In some arrangements, the tensioning members 26 may have a fixed length and provide a constant amount of tension in the collapsible support structure 12. The tension applied in the collapsible support structure 12 by the tension members 26 may help maintain tension in the cover 14. The tension applied by the tension members 26 may replace tension typically provided by the cover 14 and which is lost by providing the relatively large door assembly 16 in the cover 14, particularly when the door assembly 16 is arranged at a corner of the ground blind 10 (e.g., at an intersection of adjacent sidewalls 32 of the cover 14).

Figure 6:
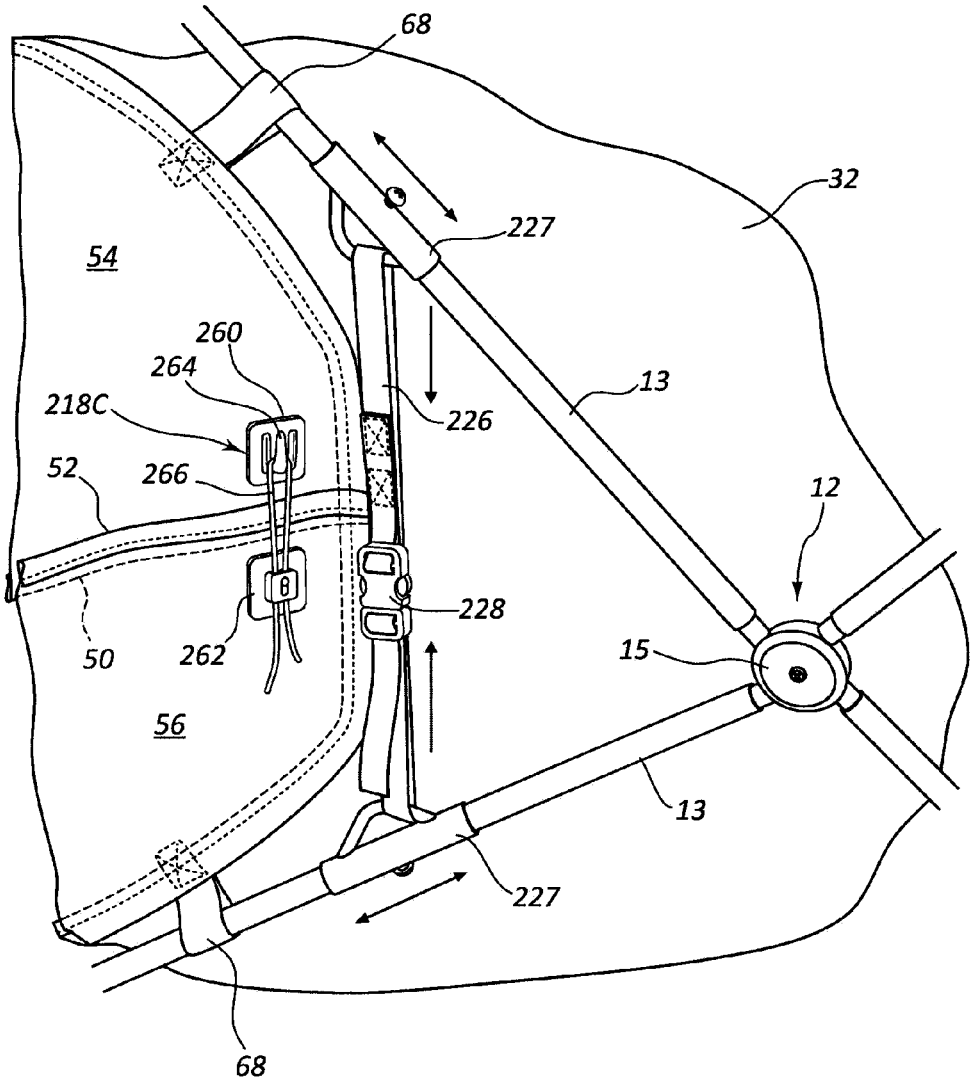
FIG. 6 shows a portion of the access opening of FIG. 4 having an alternative tensioning member.

FIG. 6 illustrates another example embodiment that includes tensioning members 226 connected to support members 25 with connectors 227. The tensioning members 226 may include strap members that have an adjustable length using, for example, adjustable fasteners 228. The fasteners 228 may include, for example, buckles, clips, or other adjustable fastening devices. The tensioning members 226 may be adjustable to alter an amount of tension in the collapsible support structure 12.

The cover 14 extends over the collapsible support structure 12 and is connected to the collapsible support structure 12 at multiple locations. Expanding the collapsible support structure 12 into the expanded position shown in FIGS. 1 and 2 expands the cover 14 into an open position that further defines the interior space of the ground blind 10. The cover 14 includes a top 30, a plurality of sidewalls or sidewall panels 32, a bottom edge 34, a top edge 36, and a plurality of corner portions 38 defined between adjacent sidewalls 32. The cover 14 also defines outer and inner surfaces 40, 42 (see FIG. 3).

The door assembly 16 is positioned at one of the corner portions 38 spanning adjacent sidewalls 32. The door assembly 16 may be positioned at other locations such as, for example, on a single one of the sidewalls 32 (e.g., above or below the crossing support members 25), spanning one of the sidewalls 32 and the top 30, or along the top 30 alone. The door assembly 16 may be arranged at any intersection of adjacent sidewalls or top 30, which intersection may be referred to as a corner. Typically, an opening defined by the door assembly 16 is arranged at a location on the ground blind 10 that does not overlap with the support members 25 of the collapsible support structure 12. The door assembly 16, when uncovered or open position, may provide an unobstructed, unencumbered opening or access into the ground blind 10.

The door assembly 16 may include an opening periphery 58 in the cover 14 formed in part by first (e.g., upper) and second (e.g., lower) door flaps 54, 56 (also referred to as door panels or door panel members). The door flaps 54, 56 may be attached directly to the cover 14 along a periphery of the opening 58. In other arrangements, the door flaps 54, 56 may be mounted to frame members 13 of the collapsible support structure 12 (see FIGS. 4-5). The door flaps 54, 56 may include sleeve portions 68 that permit sliding movement of the door flaps 54, 56 along the frame members 13 (see FIGS. 4-5). This sliding movement may assist in moving the door flaps 54, 56 between closed and open positions to help maximize an amount of the opening 58 that is exposed when the door assembly 16 is in the open position.

The frame members 13 of the collapsible support structure 12 to which the door flaps 54, 56 are mounted may have different sizes, shapes, strength properties or flexibility properties as compared to other frame members 13 of the collapsible support structure. In one example, the frame members 13 to which the door flaps 54, 56 are mounted have a greater outer diameter and an increased stiffness as compared to other frame members 13 of the collapsible support structure 12.

The collapsible support structure 12 may include a plurality of hub members 15 that connect the frame members 13 together. The hub members 15 may comprise a high strength material such as, for example, magnesium. The hub members 15 may be over molded with a protecting material such as, for example, rubber or polymer. The over mold material may help avoid hand pinches to a user if the user contacts the hub member when setting up or adjusting the collapsible support structure 12.

Figure 3:
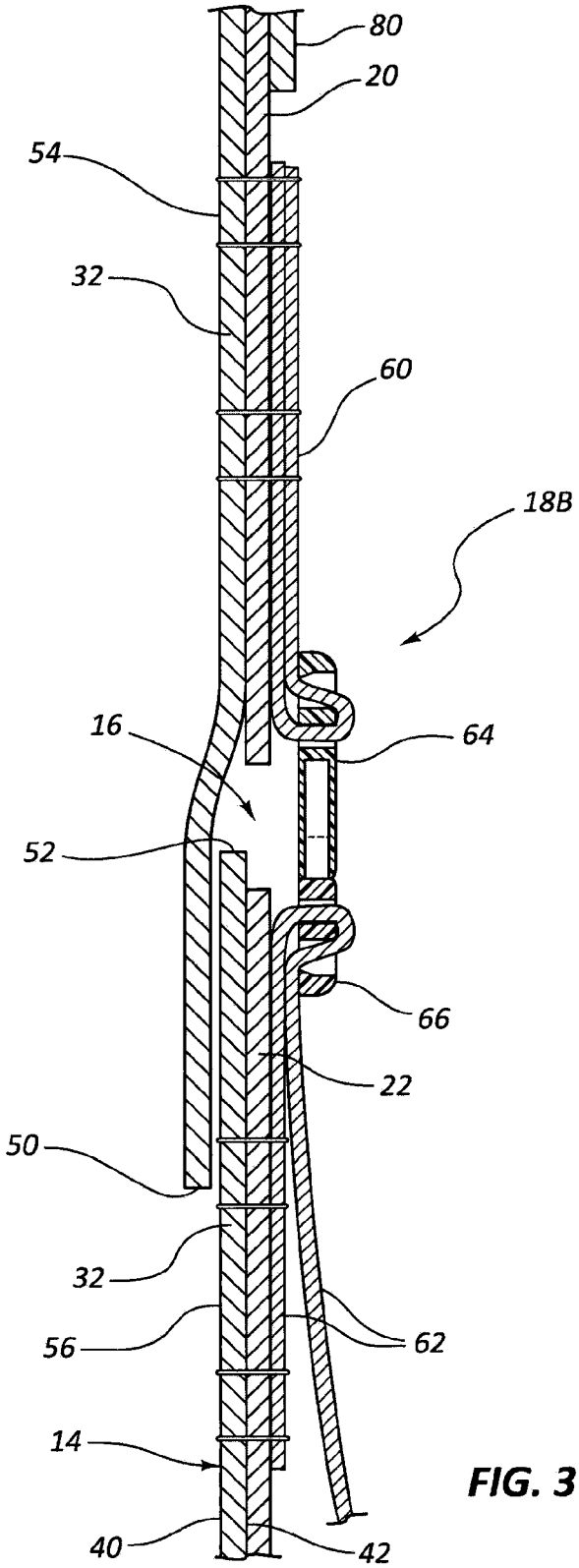
FIG. 3 is a cross-sectional view of the access opening of the ground blind of FIG. 1.

The first and second door flaps 54, 56 may define first and second opening edge portions 50, 52, respectively (see FIG. 3). The first and second opening edge portions 50, 52 may be arranged generally horizontally when the door assembly 16 is in the closed position shown in FIGS. 1 and 3. The first and second opening edge portions 50, 52 may also be referred to as upper and lower opening edge portions 50, 52. In some arrangements, the first and second opening edge portions 50, 52 overlap each other when the door assembly 16 is in the closed position. Excess or surplus material of the cover 14 may be positioned above the first opening edge portion 50 or below the second opening edge portion 52 when the door assembly 16 is in the closed position shown in FIGS. 1 and 3 to provide greater ease in opening and closing the door assembly 16.

The first and second door flaps 54, 56 are configured to move in opposite directions to provide opening of the door assembly 16. In other arrangements, a single door flap may be used to cover the door opening 58 and move to providing opening of the door assembly 16. The first and second door flaps 54, 56 may be formed independently of the cover 14 and attached to the cover 14 or collapsible support structure 12. In other arrangements, at least a portion of the first and second door flaps 54, 56 may be an integral part of the cover 14. The door opening 58 may be defined as part of the cover 14 or the door assembly 16.

The door assembly 16 may in other embodiments include at least one elastic member or other type of biasing feature positioned parallel with or at a non-perpendicular angle to the first and second opening edge portions 50, 52 on at least one of the first and second door flaps 54, 56. These additional elastic members (not shown) may assist in holding the door assembly 16 in a closed position when the door assembly 16 is in the closed position shown in FIGS. 1 and 3, or in an open position when the door assembly 16 is in the open position shown in FIG. 2. In one example, the additional elastic members (not shown) may be positioned starting at the intersection of the first and second opening edge portions 50, 52 and extend horizontally away from the door assembly 16 to assist in automatically moving the door assembly 16 into the open position shown in FIG. 2 upon release of the fasteners 18A-C.

The elastic members may be attached to a surface of the cover 14. The elastic members may be attached along the inner surface 42 on one of the first and second door flaps 54, 56 as shown in FIG. 3. In some arrangements, the elastic member is formed integral with the first and second door flaps 54, 56 or portions of the cover 14. One example includes at least one of the first and second door flaps 54, 56 formed from a sheet of material having elastic properties (e.g., spandex or elastane) that provides a biasing force to open the door assembly 16 upon release of the fasteners 18A-C.

The first and second opening edge portions 50, 52 may have a generally linear arrangement and be arranged parallel to each other when the door assembly 16 is in the closed position shown in FIG. 1. The first and second opening edge portions 50, 52 may have a different shape such as a U or a V shape when the door assembly 16 is in the open position shown in FIG. 2 after the fasteners 18A-C have been released. In some embodiments, the first and second opening edge portions 50, 52 are arranged at an angle relative to a horizontal plane. Portions of the first and second opening edge portions 50, 52 may be movable in at least one non-vertical direction.

As shown in FIGS. 2 and 5, the door assembly 16 creates a very large access opening 51 without the need for the sportsman to further enlarge the opening by pulling on the sides of the blind adjacent to the opening or by other types of manipulation. The enlarged access opening 51 provides ample room for the sportsman along with other equipment (e.g., backpack, stool, bow, gun, tripod, spotting scope, video camera, or the like) to be easily carried into the blind through the opening 51 without interference by the sides of the blind that define the periphery 58. This reduces noise and allows ingress and egress from the blind with minimal disturbance of game animals that may be in the area. The fastening system for closing the blind after the sportsman and the equipment has been placed inside the blind also allows for quiet closing of the blind, particularly as compared to zippers and the like which have been used in traditional blinds.

The door opening 51 formed by periphery 58 of the door assembly 16 may have a width $W_1$ and a height $H_1$. When the door assembly 16 is in the closed position shown in FIG. 1, the access opening 51 is completely covered by the first and second door flaps 54, 56 and there is no unimpeded access into the ground blind 10 provided by the door assembly 16. As such, the width $W_1$ and a height $H_1$ are substantially zero. When the door assembly 16 is in the open position shown in FIG. 2, the access opening 51 may have a width $W_2$ and a height $H_2$.

Typically, the maximum value of widths $W_1$, $W_2$ is in the range of about 12 inches to about 48 inches, and more preferably in the range of about 24 inches to about 36 inches. The maximum value of the heights $H_1$, $H_2$ is typically in the range of about 24 inches to about 60 inches, and more preferably in the range of about 30 inches to about 48 inches. Dimensions for the door assembly 16 may vary depending on, for example, the type of opening (e.g., a door, window, or vent opening).

A maximum value of height $H_2$ may vary depending on, for example, a construction and positioning of the first and second elastic members 20, 22. In some arrangements, multiple elastic members may be positioned on or associated with the periphery 58, including the first opening edge portion 50 to assist in moving the first opening edge portion 50 vertically upward upon release of the fasteners 18A-C. A plurality of elastic members may also be positioned on or associated with the second opening edge portion 52 to assist in moving the second opening edge portion 50 vertically downward upon release of the fasteners 18A-C.

The first and second elastic members 20, 22 may be positioned at any location along the length of each of the first and second opening edge portions 50, 52. FIGS. 2-3 illustrate first and second elastic members 20, 22 positioned at a mid-point along the length of each of the first and second opening edge portions 50, 52, respectively. The first and second elastic members 20, 22 may be positioned along or aligned parallel with the corner portion 38. The first and second elastic members 20, 22 may be spaced vertically from edges of the first and second door flaps 54, 56 to provide free material that more easily overlaps when the door assembly 16 is in the closed position.

The fasteners 18A-C may each include a first or upper fastener strap 60 and a second or lower fastener strap 62 that is connected to the cover 14 at positions above and below the first and second opening edge portions 50, 52, respectively. Each of the fasteners 18A-C may also include a first fastener portion 64 connected to the first fastener strap 60, and a second fastener portion 66 connected to the second fastener strap 62. The first and second fastener portion 64, 66 may mate or releasably connect together in a closed or connected position shown in FIG. 1. The first and second fastener portions 64, 66 may be disconnected or released from each other in an open or released position shown in FIG. 2.

Many types of fasteners may be used with the fasteners 18A-C. Some example fasteners include, for example, buckles, clips, snaps, buttons, clasps, laces, clips, hooks and loop systems, or other type of disconnectable fasteners. The fasteners 18A-C typically do not include a zipper or zipper-type structure. However, a zipper may be used in some arrangements in connection with the use of first and second elastic members 20, 22 that automatically open an access opening in a ground blind upon release of the zipper.

FIG. 6 shows an alternative fastener 218C that may be used in place of any of fasteners 18A-C. Fastener 218C includes a hook 264 and an elastic cord loop 266. The hook 264 is secured to the first door flap 54 at a reinforced area 260. The loop 266 is secured to the second door flap 56 at a reinforced area 262. The elastic properties of the loop 266 may permit some relative movement between the first and second door flaps 54, 56, respectively, to adjust closure of the door assembly 16.

The fasteners 18A-C may be connected to the cover at different locations other than adjacent to the first and second opening edge portions 50, 52. For example, the first fastener strap 60 or first fastener portion 64 may be connected along the top edge 36, along the first elastic member 20, along the perimeter 58 of the opening 51, or some other location on the cover 14 or collapsible support structure 12. The second fastener strap 62 or second fastener portion 66 may be mounted to the cover 14, for example, along the bottom edge 34, along the second elastic member 22, along the perimeter 58 of the access opening 51, or other locations on the cover 14 or collapsible support structure 12.

The door assembly 16 may be operable between closed (see FIG. 1) and open (see FIG. 2) positions using at least one single elastic member (e.g., the first or second elastic members 20, 22 or a combination thereof) associated with only one of the first and second opening edge portions 50, 52. Operating the door assembly 16 between closed and open positions may include moving only one of the first and second opening edge portions 50, 52 away from the other of the first and second opening edge portions 50, 52. In other arrangements, operating the door assembly 16 between closed and open positions may include moving both of the first and second opening edge portions 50, 52 away from each other.

The first and second elastic members 20, 22 may be mounted to the inner surface 42 of the cover 14. The fasteners 18A-C may be mounted to the outer surface 40 of the cover 14. In other arrangements, the fasteners 18A-C and first and second elastic members 20, 22 may both be positioned on the outer surface 40, both be positioned on the inner surface 42, or be switched from the positioning shown in FIG. 3.

The fasteners 18A-C may be mounted on the outer surface 40 so that the user may access the fasteners 18A-C from outside of the ground blind 10. In some arrangements, the fasteners 18A-C are mounted on the inner surface 42 for easy access from within the ground blind 10. The door assembly 16, when in a closed position, may be configured to permit the user to extend a hand between the first and second opening edge portions 50, 52 to access the fasteners 18A-C that are positioned either on an exterior or interior side of the ground blind 10. In some arrangements, separate sets of fasteners 18A-C may be positioned on the interior and exterior of the ground blind 10 so that the user may operate the door assembly 16 between open and closed positions from either inside or outside of the ground blind 10 regardless of access between the structure of the first and second opening edge portions 50, 52.

While a plurality of fasteners 18A-C are shown in the figures, a single fastener positioned at any location along the length of the first and second opening edge portions 50, 52 may be adequate to retain the door assembly 16 in a closed position. The fasteners 18A-C are arranged generally perpendicular to the first and second opening edge portions 50, 52. Other arrangements may include arranging the fasteners 18A-C at nonperpendicular angles relative to the first and second opening edge portions 50, 52.

A door retention member 80 may be connected to the first door flap 54 and be operable to retain the door assembly 16 in the open position (see FIGS. 1-2 and 4-5). The door retention member 80 may extend through a retention member opening 82 at a location vertically above the door assembly 16 and be accessible from outside of the ground blind 10. A user may operate the door retention member 80, for example, by pulling the door retention member 80 through the retention member opening 82. Operating the door retention member 80 may help hold the door opening in the open position and may further draw the first door flap 54 and first opening edge portion 50 upward to increase the open size of the door assembly 16 in the open position. The door retention member 80 may be releasably secured to the cover 14 or collapsible support structure 12 to help hold the door assembly 16 in the open position. A separate door retention member may be associated with the second door flap 56 and second opening edge portion 52 to provide a similar function of holding the door assembly 16 in an open position or enlarging an open size for the door assembly 16.

At least one of the first and second door flaps 54, 56 may include additional fasteners used to secure the first and second door flaps to the sidewalls 32 of the cover 14. FIGS. 4 and 5 show snap assemblies 70 having a first snap component 71 positioned on the second door flap 56 and a second snap component 72 positioned on the sidewall 32 adjacent to the access opening 51. Connecting the first and second snap components 71, 72 together holds side edges of the second door flap 56 in place relative to the sidewalls 32. The snap assemblies 70 may provide a quick connect/disconnect of the second door flap 56 to the sidewalls 32 with the second door flap 56 in a closed position.

Figure 7:
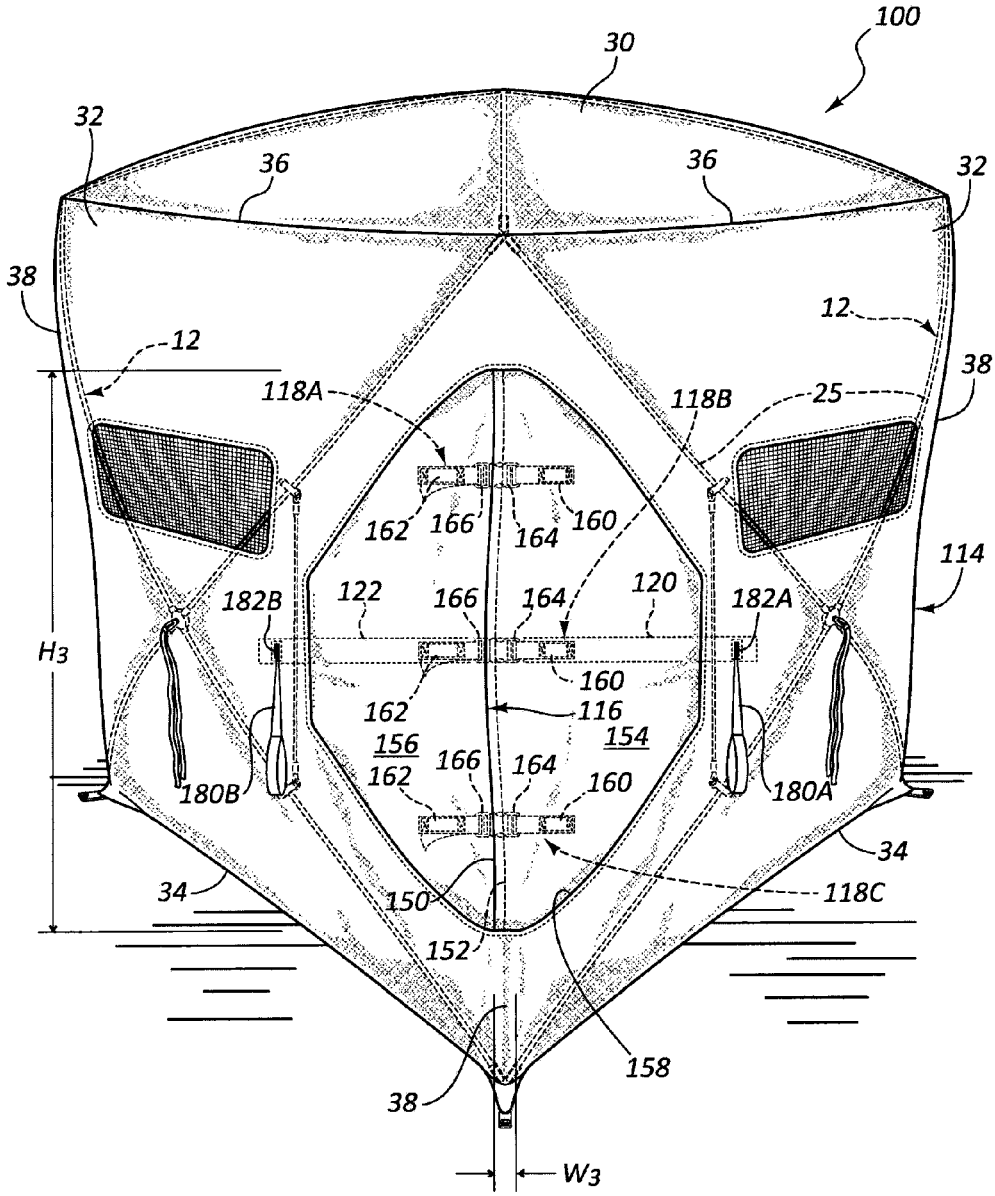
FIG. 7 is a perspective view of another example ground blind having an access opening in a closed position.
Figure 8:
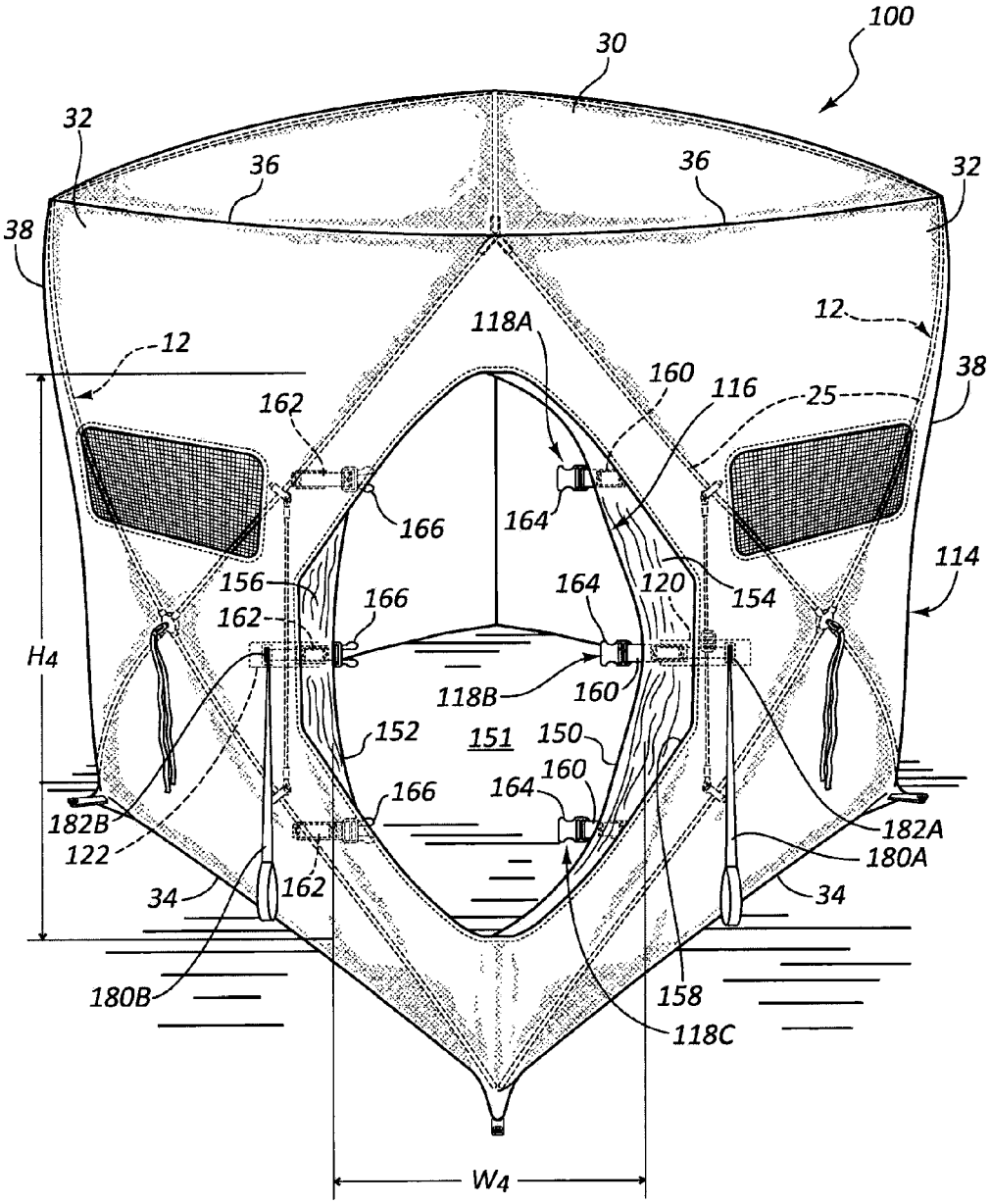
FIG. 8 is a perspective view of the ground blind of FIG. 7 with the access opening in an open position.

Referring now to FIGS. 7-8, another example ground blind 100 includes a collapsible support structure 12, a cover 114, and a door assembly 116. The door assembly 116 includes an opening 158 and first and second door flaps 154, 156 (also referred to herein as door panels or door panel members). The first and second door flaps 154, 156 define first and second opening edge portions 150, 152 that are arranged vertically when the door assembly 116 is in the closed position. The door assembly 116 may operable between the closed position shown in FIG. 7 and an open position shown in FIG. 8 by moving the first and second opening edge portions 150, 152 away from each other in a generally horizontal direction.

The door assembly 116 may include first and second elastic members 120, 122 that apply a biasing force that automatically moves the door assembly 116 between the closed position shown in FIG. 7 and the open position shown in FIG. 8 upon release of the fasteners 118A-C. The fasteners 118A-C may each include a first or upper fastener strap 160 and a second or lower fastener strap 162 that is connected to the cover 114 or first and second door flaps 154, 156. The fasteners 118A-C may be positioned spaced from the first and second opening edge portions 150, 152, respectively. Each of the fasteners 118A-C may also include a first fastener portion 164 connected to the first fastener strap 160, and a second fastener portion 166 connected to the second fastener strap 162. The first and second fastener portions 164, 166 may mate or releasably connect together in a closed or connected position shown in FIG. 7. The first and second fastener portions 164, 166 may be disconnected or released from each other in an open or released position shown in FIG. 8. The ground blind 100 may include the same or similar features to ground blind 10 described above including alternative features and arrangements described with reference to ground blind 10.

A pair of door retention members 180A-B may be connected to the first door flap 154 and be operable to retain the door assembly 116 in the open position. The door retention members 180A-B may extend through retention member opening 182A-B, respectively at a location laterally adjacent to the door assembly 116 and be accessible from outside of the ground blind 100. A user may operate the door retention members 180A-B, for example, by pulling the door retention members 180A-B through the retention member openings 182A-B. Operating the door retention members 180A-B may help hold the door assembly 116 in the open position and may further draw the first and second door flaps 154, 156 laterally to increase the open size of the door assembly 116 in the open position.

As shown in FIG. 8, the door assembly 116 creates a very large access opening 151 without the need for the sportsman to further enlarge the opening by pulling on the sides of the blind adjacent to the opening or by other types of manipulation. The enlarged access opening 151 provides ample room for the sportsman along with other equipment (e.g., backpack, stool, bow, gun, tripod, spotting scope, video camera, or the like) to be easily carried into the blind through the opening 151 without interference by the sides of the blind that define the periphery 58. This reduces noise and allows ingress and egress from the blind with minimal disturbance of game animals that may be in the area. The fastening system for closing the blind after the sportsman and the equipment has been placed inside the blind also allows for quiet closing of the blind, particularly as compared to zippers and the like which have been used in traditional blinds.

Other orientations are possible for the door assemblies 16, 116 disclosed herein. For example, the door opening may be arranged at a diagonal angle between the horizontal arrangement shown in FIG. 1 and the vertical arrangement shown in FIG. 7. The door opening may be constructed with different sizes and shapes when in the open and closed positions. For example, the door opening edge portions may have a contoured shape when in the closed position rather than the generally linear shape shown in FIGS. 1 and 7. In one example, the door opening has a rectangular or triangular shape when in the closed position. In such an arrangement, an elastic member may be positioned along only one of the opening edge portions to automatically move the opening into an open position upon release of the fasteners that hold the opening in the closed position. The openings 58, 158 may have different shapes and sizes such as, for example, rectangular, triangular, hexagonal, or circular.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive, and that reference be made to the appended claims and their equivalents for determining the scope of the instant disclosure. In addition, for ease of use, the words "including" and "having," as used in the specification and claims, are interchangeable with and have the same meaning as the word "comprising."

What is claimed is:

1. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning a portion of one of the side panels, and at least two door panel members each configured to at least partially cover the door opening in a closed position, at least one of the two door panel members being movable into an open position under a bias force applied along a mid-span portion of an edge of at least one of the two door panel members to expose a portion of the door opening and provide unencumbered access into the ground blind, the door opening being defined by movement of each of the at least two door panel members relative to each other, further comprising at least one elastic member configured to bias at least one of the at least two door panel members into the open position;

wherein the at least two door panel members include first and second door panel members that define first and second opening edges, respectively, and the at least one elastic member is configured to move at least one of the first and second opening edges away from the other of the first and second opening edges upon release of at least one fastener;

wherein the at least one elastic member includes a first elastic member associated with the first opening edge and a second elastic member associated with the second opening edge, wherein the first and second elastic members operate to move the first and second opening edges away from each other upon release of the at least one fastener.

2. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning a portion of one of the side panels, and at least two door panel members each configured to at least partially cover the door opening in a closed position, at least one of the two door panel members being movable into an open position under a bias force applied along a mid-span portion of an edge of at least one of the two door panel members to expose a portion of the door opening and provide unencumbered access into the ground blind, the door opening being defined by movement of each of the at least two door panel members relative to each other;

wherein the collapsible support structure includes a separate frame subassembly supporting each of the side panels and top of the flexible cover, wherein each frame subassembly includes a plurality of frame legs, and the at least one door panel member is connected to the frame legs;

wherein the at least one door panel member is slideable along the frame legs to move from the closed position to the open position.

3. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning a portion of one of the side panels, and at least two door panel members each configured to at least partially cover the door opening in a closed position, at least one of the two door panel members being movable into an open position under a bias force applied along a mid-span portion of an edge of at least one of the two door panel members to expose a portion of the door opening and provide unencumbered access into the ground blind, the door opening being defined by movement of each of the at least two door panel members relative to each other;

further comprising at least one elastic member configured to bias at least one of the at least two door panel members into the open position;

wherein the at least one elastic member is positioned in the door opening when the at least one of the at least two door panel members is in the closed position.

4. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning a portion of one of the side panels, and at least two door panel members each configured to at least partially cover the door opening in a closed position, at least one of the two door panel members being movable into an open position under a bias force applied along a mid-span portion of an edge of at least one of the two door panel members to expose a portion of the door opening and provide unencumbered access into the ground blind, the door opening being defined by movement of each of the at least two door panel members relative to each other;

wherein the collapsible support structure includes a separate frame subassembly supporting each of the side panels and top of the flexible cover, wherein each frame subassembly includes a plurality of frame legs, and each of the frame subassemblies supporting the side panel spanned by the door opening include at least one tension member that extends between adjacent frame legs to maintain tension in the frame subassembly;

wherein the tension members are removable from the frame subassemblies independent of the flexible cover.

5. A ground blind, comprising:

a collapsible support structure having a plurality of frame members;

a cover connected to the collapsible support structure, the cover including at least two side panels that intersect at a corner, and a door opening defined in the corner and extending onto the two side panels;

a door assembly including first and second door panels vertically movable relative to each other between a closed position in which each of the first and second door panels at least partially cover the door opening and an open position wherein portions of the door opening are exposed to provide unobstructed access into the ground blind at the corner;

wherein at least one of the first and second door panels is movable under a bias force applied along a mid-span portion of an edge of the at least one of the first and second door panels;

further comprising a biasing member operable to automatically move the first and second door panels away from each other into the open position;

wherein the biasing member is positioned in the door opening when the first and second door panels are in the closed position.

6. A ground blind, comprising:

a collapsible support structure having a plurality of frame members;

a cover connected to the collapsible support structure, the cover including at least two side panels that intersect at a corner, and a door opening defined in the corner and extending onto the two side panels;

a door assembly including first and second door panels vertically movable relative to each other between a closed position in which each of the first and second door panels at least partially cover the door opening and an open position wherein portions of the door opening are exposed to provide unobstructed access into the ground blind at the corner;

wherein at least one of the first and second door panels is movable under a bias force applied along a mid-span portion of an edge of the at least one of the first and second door panels;

wherein the collapsible support structure includes at least one tension member extending between pairs of the frame members adjacent to the door opening to maintain tension in the cover;

wherein the at least one tension member is removable from the frame members independent of the cover.

7. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning a portion of one of the side panels, and first and second door panel members defining first and second opening edges and being configured to cover the door opening when in a closed position, the first and second door panel members being movable into an open position to expose a portion of the door opening and provide unencumbered access into the ground blind, the door opening being defined by movement of each of the first and second door panel members relative to each other;

a first elastic member associated with the first opening edge and a second elastic member associated with the second opening edge, the first and second elastic members being configured to bias the first and second opening edges away from each other upon release of at least one fastener.

8. The ground blind of claim 7, wherein the first and second elastic members are integrated into the first and second door panel members, respectively.

9. The ground blind of claim 7, wherein the at least one fastener is a non-zipping, disconnectable fastener.

10. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning one of the side panels, and at least two door panel members configured to cover the door opening when the at least two door panel members are in a closed position, the at least two door panel members being movable into an open position to expose a portion of the door opening and provide unencumbered access into the ground blind, the door opening being defined by movement of each of the at least two door panel members relative to each other;

wherein the collapsible support structure includes a separate frame subassembly supporting each of the side panels and top of the flexible cover, wherein each frame subassembly includes a plurality of frame legs, and the at least two door panel members are connected to the frame legs and are slideable along the frame legs to move from the closed position to the open position.

11. The ground blind of claim 10, wherein each of the at least two door panel members is independently movable relative to the flexible cover.

12. The ground blind of claim 10, wherein at least one of the at least two door panel members at least partially overlaps at least one other door panel member.

13. The ground blind of claim 10, further comprising a door retention member connected to at least one of the at least two door panel members.

14. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning one of the side panels, and at least two door panel members configured to cover the door opening when the at least two door panel members are in a closed position, at least one of the at least two door panel members being movable into an open position to expose a portion of the door opening and provide unencumbered access into the ground blind, the door opening being defined by movement of each of the at least two door panel members relative to each other;

at least one elastic member configured to bias at least one of the at least two door panel members into the open position;

wherein the at least one elastic member is positioned in the door opening when the at least one of the at least two door panel members is in the closed position.

15. The ground blind of claim 14, further comprising at least one fastener configured to releasably hold at least one of the at least two door panel members in the closed position.

16. The ground blind of claim 15, wherein the at least one fastener is a non-zipping, disconnectable fastener.

17. The ground blind of claim 14, wherein the at least two door panel members include first and second door panel members that define first and second opening edges, respectively, and the at least one elastic member is configured to move at least one of the first and second opening edges away from the other of the first and second opening edges upon release of at least one fastener.

18. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning one of the side panels, and at least two door panel members configured to cover the door opening when the at least two door panel members are in a closed position, at least one of the at least two door panel members being movable into an open position to expose a portion of the door opening and provide unencumbered access into the ground blind, the door opening being defined by movement of each of the at least two door panel members relative to each other;

wherein the collapsible support structure includes a separate frame subassembly supporting each of the side panels and top of the flexible cover, wherein each frame subassembly includes a plurality of frame legs, and each of the frame subassemblies supporting the side panel spanned by the door opening include at least one tension member that extends between adjacent frame legs to maintain tension in the frame subassembly;

wherein the at least one tension member is removable from the frame subassembly independent of the flexible cover.

19. The ground blind of claim 18, wherein each of the at least two door panel members is independently movable relative to the flexible cover.

20. The ground blind of claim 18, wherein at least one of the at least two door panel members at least partially overlaps at least one other door panel member.

21. The ground blind of claim 18, further comprising a door retention member connected to at least one of the at least two door panel members.

22. A ground blind, comprising:

a collapsible support structure having a plurality of frame members;

a cover connected to the collapsible support structure, the cover including at least two side panels that intersect at a corner, and a door opening defined in one of the side panels;

a door assembly including first and second door panels vertically movable relative to each other between a closed position covering the door opening and an open position wherein portions of the door opening are exposed to provide unobstructed access into the ground blind at the corner;

a biasing member operable to automatically move the first and second door panels away from each other into the open position;

wherein the biasing member is positioned in the door opening when the first and second door panels are in the closed position.

23. The ground blind of claim 22, wherein the first door panel defines a first horizontally oriented edge, and the second door panel defines a second horizontally oriented edge, and the first and second door panels are vertically movable to separate the first and second horizontally oriented edges away from each other.

24. The ground blind of claim 22, wherein the door assembly further comprises at least one fastener configured to hold the first and second door panels in the closed position.

25. The ground blind of claim 24, wherein the at least one fastener includes a releasable clip.

26. A ground blind, comprising:

a collapsible support structure having a plurality of frame members;

a cover connected to the collapsible support structure, the cover including at least two side panels that intersect at a corner, and a door opening defined in one of the side panels;

a door assembly including first and second door panels vertically movable relative to each other between a closed position covering the door opening and an open position wherein portions of the door opening are exposed to provide unobstructed access into the ground blind at the corner;

wherein the collapsible support structure includes at least one tension member extending between pairs of the frame members adjacent to the door opening to maintain tension in the cover;

wherein the at least one tension member is removable from the frame members independent of the cover.

27. The ground blind of claim 26, wherein the first and second door panels at least partially overlap while in the closed position.

28. The ground blind of claim 26, wherein the first door panel defines a first horizontally-oriented edge, and the second door panel defines a second horizontally-oriented edge, and the first and second door panels are vertically movable to separate the first and second horizontally-oriented edges away from each other.

29. The ground blind of claim 26, further comprising a door retention member connected to at least one of the first and second door panels.

30. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning a portion of one of the side panels, and at least two door panel members configured to cover the door opening in a closed position, at least one of the two door panel members being movable into an open position under a bias force applied along a mid-span portion of an edge of at least one of the two door panel members to expose a portion of the door opening and provide unencumbered access into the ground blind, the door opening being defined by movement of each of the at least two door panel members relative to each other;

at least one elastic member configured to bias at least one of the at least two door panel members into the open position;

wherein the at least two door panel members include first and second door panel members that define first and second opening edges, respectively, and the at least one elastic member is configured to move at least one of the first and second opening edges away from the other of the first and second opening edges upon release of at least one fastener;

wherein the at least one elastic member includes a first elastic member associated with the first opening edge and a second elastic member associated with the second opening edge, wherein the first and second elastic members operate to move the first and second opening edges away from each other upon release of the at least one fastener.

31. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning a portion of one of the side panels, and at least two door panel members configured to cover the door opening in a closed position, at least one of the two door panel members being movable into an open position under a bias force applied along a mid-span portion of an edge of at least one of the two door panel members to expose a portion of the door opening and provide unencumbered access into the ground blind, the door opening being defined by movement of each of the at least two door panel members relative to each other;

wherein the collapsible support structure includes a separate frame subassembly supporting each of the side panels and top of the flexible cover, wherein each frame subassembly includes a plurality of frame legs, and the at least one door panel member is connected to the frame legs;

wherein the at least one door panel member is slidable along the frame legs to move from the closed position to the open position.

32. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning a portion of one of the side panels, and at least two door panel members configured to cover the door opening in a closed position, at least one of the two door panel members being movable into an open position under a bias force applied along a mid-span portion of an edge of at least one of the two door panel members to expose a portion of the door opening and provide unencumbered access into the ground blind, the door opening being defined by movement of each of the at least two door panel members relative to each other;

at least one elastic member configured to bias at least one of the at least two door panel members into the open position;

wherein the at least one elastic member is positioned in the door opening when the at least one of the at least two door panel members is in the closed position.

33. A ground blind, comprising:

a collapsible support structure;

a flexible cover mounted to the collapsible support structure, the flexible cover including a top and a continuous sidewall, the sidewall defining a plurality of side panels;

a door arrangement including a door opening spanning a portion of one of the side panels, and at least two door panel members configured to cover the door opening in a closed position, at least one of the two door panel members being movable into an open position under a bias force applied along a mid-span portion of an edge of at least one of the two door panel members to expose a portion of the door opening and provide unencumbered access into the ground blind, the door opening being defined by movement of each of the at least two door panel members relative to each other;

wherein the collapsible support structure includes a separate frame subassembly supporting each of the side panels and top of the flexible cover, wherein each frame subassembly includes a plurality of frame legs, and each of the frame subassemblies supporting the side panel spanned by the door opening include at least one tension member that extends between adjacent frame legs to maintain tension in the frame subassembly;

wherein the tension members are removable from the frame subassemblies independent of the flexible cover.

* * * * *